US012312866B2

(12) United States Patent
Koskinen et al.

(10) Patent No.: US 12,312,866 B2
(45) Date of Patent: May 27, 2025

(54) DRILL ASSEMBLY FOR PERCUSSIVE DRILLING, A DRILL BIT AND A DRILL STRING ELEMENT

(71) Applicant: ROBIT PLC, Lempäälä (FI)

(72) Inventors: Mika Koskinen, Tampere (FI); Kimmo Ala-Kanto, Tampere (FI)

(73) Assignee: ROBIT PLC, Lempäälä (FI)

( * ) Notice: Subject to any disclaimer, the term of this patent is extended or adjusted under 35 U.S.C. 154(b) by 0 days.

(21) Appl. No.: 18/004,481

(22) PCT Filed: Jul. 8, 2020

(86) PCT No.: PCT/FI2020/050486

§ 371 (c)(1),
(2) Date: Jan. 6, 2023

(87) PCT Pub. No.: WO2022/008786

PCT Pub. Date: Jan. 13, 2022

(65) Prior Publication Data

US 2024/0263525 A1 Aug. 8, 2024

(51) Int. Cl.

| | |
|---|---|
| ***E21B 10/36*** | (2006.01) |
| ***E21B 6/00*** | (2006.01) |
| ***E21B 17/042*** | (2006.01) |

(52) U.S. Cl.

CPC ..... *E21B 10/36* (2013.01); *E21B 6/00* (2013.01); *E21B 17/0426* (2013.01)

(58) Field of Classification Search

CPC ..... E21B 10/36; E21B 17/0426; E21B 4/14; E21B 6/00

See application file for complete search history.

(56) References Cited

U.S. PATENT DOCUMENTS

| | | | |
|---|---|---|---|
| 5,984,030 | A | 11/1999 | Larsson et al. |
| 6,253,864 | B1 | 7/2001 | Hall |

(Continued)

FOREIGN PATENT DOCUMENTS

| | | | |
|---|---|---|---|
| EP | 3589817 | A1 | 1/2020 |
| EP | 3670824 | A1 | 6/2020 |
| WO | 9630620 | A1 | 10/1996 |

OTHER PUBLICATIONS

International Search Report (PCT/ISA/210) and Written Opinion (PCT/ISA/237) mailed on Mar. 9, 2021, by the European Patent Office as the International Searching Authority for International Application No. PCT/FI2020/050486. (10 pages).

*Primary Examiner* — Yong-Suk (Philip) Ro
(74) *Attorney, Agent, or Firm* — Buchanan Ingersoll & Rooney PC

(57) ABSTRACT

A drill assembly for percussive drilling, includes a drill bit having a downhole portion and an attachment portion having a cylindrical male coupling thread, and a drill string element for transferring impacts from a percussion device to the drill bit and having a female coupling thread for threadedly coupling with the male coupling thread. The drill bit includes a first annular impact surface arranged on an uphole-side end the downhole portion, the first annular impact surface surrounding the attachment portion, and the drill string element includes, at a downhole-side end thereof, a second annular impact surface. The first and second impact surfaces are inclined with respect to a plane perpendicular to the longitudinal direction. A drill bit and drill string element are also disclosed.

18 Claims, 3 Drawing Sheets

(56) References Cited

U.S. PATENT DOCUMENTS

| | | | | |
|---|---|---|---|---|
| 2020/0011136 | A1 | 1/2020 | Korte et al. | |
| 2020/0087994 | A1* | 3/2020 | Hogan | E21B 10/36 |

* cited by examiner

DRILL ASSEMBLY FOR PERCUSSIVE DRILLING, A DRILL BIT AND A DRILL STRING ELEMENT

FIELD OF THE DISCLOSURE

The present disclosure relates to percussive drilling, and more particularly to a drill assembly for percussive drilling. The present disclosure further concerns a drill bit and a drill string element which can be coupled to each other.

BACKGROUND OF THE DISCLOSURE

In percussive drilling, a drill bit exerts percussive impacts on the bottom of the borehole, so as to penetrate further into the ground. Percussive drilling is often used in hard ground conditions (e.g. rock) as this is faster than rotary drilling. Such percussive drill bits are commonly equipped with bit inserts, which impact against the bottom of the borehole, thus crushing the ground material thereat.

In so-called top-hammer applications, a percussion device, also known as a rock drill, is situated at the surface in connection with a drilling rig. The rock drill is coupled to the drill bit with a drill string comprising a plurality or drill rods or pipes. Typically, the drill string is also used to both rotate the drill bit and feed it further into the ground.

As these percussive impacts are used to break the ground at the bottom of the borehole, it is important, that the impact energy of these percussive impacts is transmitted to the leading end surface of the drill bit with as little impact energy losses as possible, in order to improve the efficiency of the drilling operation.

The overall efficiency of the drilling operation, as considered as the depth drilled in a given amount of time, depends on how often consumables, such as the drill bit, need to be replaced. To this end, it is generally considered desirable to improve the service life of consumables, such as the drill bit, as considered as the depth drilled before requiring replacement. Wear of the drill bit occurs during each impact, and thus, increasing the drill bit's ability to penetrate the ground during each impact improves its service life and the overall efficiency of the drilling operation.

Publication WO 96/30620 discloses a rock drilling tool having a shoulder abutment for transmitting impact energy to a drill bit.

BRIEF DESCRIPTION OF THE DISCLOSURE

An object of the present disclosure is to provide a drill assembly, a drill bit and a drill string element, with which an improved service life of the drill bit is achieved.

The object of the disclosure is achieved by a drill assembly, drill bit and drill string element which are characterized by what is stated in the independent claims. The preferred embodiments of the disclosure are disclosed in the dependent claims.

The disclosure is based on the idea of transmitting percussive impacts to the drill bit via an annular impact surface, which is situated at a radially outer periphery portion thereof. In this way, the impact energy of the percussive impacts is transmitted more efficiently to the bit inserts arranged at a radially peripheral portion of the drill bit's end surface.

This improves the drill bits ability to penetrate through the bottom of the borehole, as it has been found that bit inserts at the radially peripheral portion have a higher contribution in the borehole formation than bit inserts at a radially inner portion of the drill bit's end surface. This is considered to be caused by the fact that the bit inserts at the radially peripheral portion of the end surface sweep across a larger surface of the borehole's bottom during each revolution of the drill bit, as compared to bit inserts at a radially inner portion of the drill bit's end surface.

However, such impact surfaces are prone to swaging, peening or both. This results in the drill bit becoming seized, thereby impeding removal thereof. Consequently, the overall efficiency of the drilling operation has not conventionally been significantly improved, although the service life of the drill bit itself is improved. To this end, the present disclosure suggests providing impact surfaces with respect to a plane perpendicular to the longitudinal direction. This increases the surface area between the impact surfaces. Consequently, a smaller surface pressure between the impact surfaces is achieved, resulting in less swaging/peening of these surfaces caused by the percussive impacts.

As the ground material is crushed more efficiently, fewer impacts of each bit insert against the bottom of the borehole is required to achieve a borehole of a given depth. Consequently, less wear of the bit inserts is caused for a given depth of the borehole, thereby increasing the service life of the drill bit. As swaging or peening of the impact surface is reduced, the overall efficiency of the drilling operation may also be improved.

According to a first aspect of the present disclosure, a drill assembly for percussive drilling is provided.

The drill assembly comprises a drill bit extending along a longitudinal direction and having a downhole portion having a downhole end surface equipped with inserts for transferring percussive impacts to points of contact with a borehole. Such inserts are provided at least at a radially peripheral portion of the end surface. The drill bit further comprises an attachment portion extending from the downhole portion towards an uphole direction, the attachment portion having a cylindrical male coupling thread.

The drill assembly further comprises a cylindrical hollow drill string element, for transferring at least percussive impacts from a percussion device to the drill bit. Advantageously, the drill string element additionally transfers one or more of a rotational movement, an axial feed movement and a flushing fluid flow to the drill bit. Examples of such drill string elements include as an adaptor, such as an adaptor for attaching the male thread of the drill bit to a male thread of a drill rod, or a drill rod, such as a conventional drill rod or a tube rod. The drill string element extends along the longitudinal direction and has, on a downhole-side end thereof, a female coupling thread for threadedly coupling with the male coupling thread.

The drill bit further comprises a first annular impact surface arranged on an uphole-side end the downhole portion, such that the first annular impact surface surrounds the attachment portion. Respectively, the drill string element comprises, at a downhole-side end thereof, a second annular impact surface. Suitably, the second impact surface surrounds the opening in which the female coupling thread is arranged. Particularly, the first impact surface abuts the second impact surface when the drill bit is threadedly coupled with the drill string element so as to transfer percussive impact from the drill string element to the drill bit through the first and second impact surfaces.

With such an arrangement, percussive impacts are exerted on a radially peripheral portion of the drill bit, and consequently, are conveyed more efficiently to the inserts on said radially peripheral portion of the downhole end surface. Particularly, as the impacts directed from the drill string element of the end surface are not transmitted through the attachment portion nor need they to be conveyed laterally within the downhole portion to reach to the inserts on the radially peripheral portion of the end surface, the impact energy is more efficiently transmitted to said inserts. As the inserts on the peripheral portion of the end surface play a larger role in penetrating the bottom of the borehole, more efficient penetration is achieved, and less wear of the drill bit/inserts occurs per drilled meter Particularly, the first impact surface, and respectively, the second impact surface are inclined with respect to a plane perpendicular to the longitudinal direction.

This increases the surface area between the impact surfaces. Consequently, a smaller surface pressure between the impact surfaces is achieved, resulting in less swaging/peening of these surfaces caused by the percussive impacts. This, in turn, facilitates removal and replacement of the drill bit and drill string component from each other, thus improving the overall efficiency of the drilling operation.

As a result, improved service life of the drill bit is achieved, while minimizing the drawbacks of annular impact surfaces, thereby significantly improving the overall efficiency of the drilling operation.

Preferably, but not necessarily, the first impact surface, and respectively, the second impact surface are inclined radially outwardly towards a downhole direction.

With such an arrangement impact forces strive to push the first impact surface inwardly, and second impact surface outwardly, with respect to a central longitudinal axis of the drill assembly. As a result, any swaging of the first and second impact surface will be directed away from each other, which in turn, reduces the risk of the impact surfaces seizing together.

Preferably, but not necessarily, the first impact surface, and respectively, the second impact surface are inclined at an angle of between 3-20 deg.

More preferably, but not necessarily, the first impact surface, and respectively, the second impact surface are inclined at an angle of between 5-10 deg.

Most preferably, but not necessarily, the first impact surface, and respectively, the second impact surface are inclined at an angle of approximately 8 deg. For example, such an inclination has been considered particularly advantageous, when the male coupling thread and the female coupling thread are provided with a trapezoidal thread form having a pitch of between 15 mm-21 mm.

Such inclinations discussed above have been found to provide a suitable compromise between the capability of transferring axially directed percussive impacts and reducing peening/swaging of the impact surfaces.

In an embodiment of the first aspect according to the present disclosure, the drill bit comprises a cavity for conducting a flushing flow. The cavity is open towards an uphole-side end of the attachment portion. The drill bit further comprises a plurality of conduits extending between the cavity and the end surface of the drill bit for conducting the flushing flow to the end surface.

Suitably, the cavity 6 may extend longitudinally through the length of attachment portion 3 for a distance into the downhole portion 2.

Suitably, the cavity 6 may be arranged concentric with a longitudinal axis of the drill bit, whereas at least some of the conduits are non-concentric with the longitudinal axis of the drill bit.

It is considered that such a cavity formed within the drill bit acts as a pressure accumulator or equalizer, which allows for a more even flow of the flushing fluid to the end surface. Particularly, when the end surface of the drill bit impacts the bottom of the borehole, a pressure shock is induced. Such a pressure shock then travels towards the uphole direction disturbing the flow of the flushing fluid which, in turn flows in a downhole direction. The increase in volume provided by the cavity enables the pressure shock to attenuate, as the flushing fluid carrying the pressure shock is able to expand within the cavity. Consequently, less disturbance is caused to the flow of the flushing fluid and proper fluid flow is better achieved between successive impacts.

This results in a more even flushing flow over the end surface which, in turn, translates less debris between the end surface and the bottom of the borehole and improved durability of the drill bit.

As the present disclosure provides for less of the impact energy being transmitted through the attachment portion, the material thickness thereat may be reduced, thus allowing for a larger cavity to be formed and improving the durability of the drill bit, as discussed above.

For example, the drill assembly may further comprise a flow restricting element nested within the cavity, such that an annular flow route for the flushing flow is formed within the cavity. It is envisaged that an annular flow route formed between the cavity's walls and the flow restricting element better distributes the flushing fluid between the plurality of conduits, thereby resulting in a more uniform flushing fluid flow to the end surface of the drill bit. This improves flushing of cutting debris from between the end surface of the drill bit and the bottom of the borehole, which increases the durability of the drill bit.

For example, such a flow restricting element may be provided as a surveying tool configured to measure parameters related to drilling and/or the borehole.

Preferably, but not necessarily, the cavity has a diameter at least 2 times larger than that of a conduit.

Preferably, but not necessarily, the cavity has a diameter of at least 2 times that of a conduit.

Preferably, but not necessarily, the cavity extends parallel to the longitudinal direction, whereas the plurality of conduits are inclined with respect to the axial direction.

Preferably, but not necessarily, the volume defined by the cavity is at least 2 times of that defined by the plurality of conduits. More preferably, but not necessarily, the volume defined by the cavity is at least 3,5 times of that defined by the plurality of conduits. Most preferably, but not necessarily, the volume defined by the cavity is at least 5 times of that defined by the plurality of conduits.

It should be noted that the first aspect of the present disclosure encompasses any combination of two or more embodiments, or variants thereof, as discussed above.

According to a second aspect of the present disclosure a drill bit for percussive drilling, is provided. Particularly, the drill bit may be a drill bit described in connection with the first aspect of the present disclosure.

The drill bit comprises a downhole portion having a downhole end surface equipped with inserts for transferring percussive impacts to points of contact with a borehole, and an attachment portion extending from the downhole portion towards an uphole direction, the attachment portion having a cylindrical male coupling thread.

The drill bit further comprises a first annular impact surface arranged on an uphole-side end the downhole portion, such that the first annular impact surface surrounds the attachment portion. Particularly, the first impact surface is configured to abut a second impact surface of a drill string element when the drill bit is threadedly coupled thereto, so as to transfer percussive impacts from the drill string element to the drill bit through the first and second impact surfaces.

Particularly, the first impact surface, is inclined with respect to a plane perpendicular to the longitudinal direction.

Preferably, but not necessarily, the first impact surface is inclined radially outwardly towards a downhole direction.

Preferably, but not necessarily, the first impact surface is inclined at an angle of between 3-20 deg.

More preferably, but not necessarily, the first impact surface is inclined at an angle of between 5-10 deg.

Most preferably, but not necessarily, the first impact surface is inclined at an angle of approximately 8 deg. For example, such an inclination has been considered particularly advantageous, when the male coupling thread is provided with a trapezoidal thread form having a pitch of between 15 mm-21 mm.

In an embodiment according to the second aspect of the present disclosure, the drill bit comprises a cavity for conducting a flushing flow. The cavity is open towards an uphole-side end of the attachment portion. The drill bit further comprises a plurality of conduits extending between the cavity and the end surface of the drill bit for conducting the flushing flow to the end surface.

Preferably, but not necessarily, the cavity has a diameter of at least 2 times that of a conduit.

Preferably, but not necessarily, the cavity extends parallel to the longitudinal direction, whereas the plurality of conduits are inclined with respect to the axial direction.

Preferably, but not necessarily, the volume defined by the cavity is at least 2 times of that defined by the plurality of conduits. More preferably, but not necessarily, the volume defined by the cavity is at least 3,5 times of that defined by the plurality of conduits. Most preferably, but not necessarily, the volume defined by the cavity is at least 5 times of that defined by the plurality of conduits.

It should be noted that the second aspect of the present disclosure encompasses any combination of two or more embodiments, or variants thereof, as discussed above.

According to a third aspect of the present disclosure, a drill string element for percussive drilling, such as an adaptor or drill rod, for transferring at least percussive impacts from a percussion device to a drill bit, is provided. Particularly, the drill string element may be a drill string element described in connection with the first aspect of the present disclosure.

The drill string element comprises a cylindrical hollow body extending along a longitudinal direction and having, on a downhole-side end thereof, a female coupling thread for threadedly coupling with a male coupling thread of a drill bit.

The drill string element comprises, at a downhole-side end thereof, a second annular impact surface. The second impact surface is configured to abut a first impact surface of a drill bit when threadedly coupled thereto, so as to transfer percussive impact from the drill string element to the drill bit through the first and second impact surfaces.

Particularly, the second impact surface is inclined with respect to a plane perpendicular to the longitudinal direction.

Preferably, but not necessarily, the second impact surface is inclined radially outwardly towards a downhole direction.

Preferably, but not necessarily, the second impact surface is inclined at an angle of between 3-20 deg.

More preferably, but not necessarily, the second impact surface is inclined at an angle of between 5-10 deg.

Most preferably, but not necessarily, the second impact surface is inclined at an angle of approximately 8 deg. For example, such an inclination has been considered particularly advantageous, when the female coupling thread is provided with a trapezoidal thread form having a pitch of between 15 mm-21 mm.

It should be noted that the third aspect of the present disclosure encompasses any combination of two or more embodiments, or variants thereof, as discussed above.

BRIEF DESCRIPTION OF THE DRAWINGS

In the following the disclosure will be described in greater detail by means of preferred embodiments with reference to the accompanying drawings, in which.

DETAILED DESCRIPTION OF THE DISCLOSURE

Figure 1:
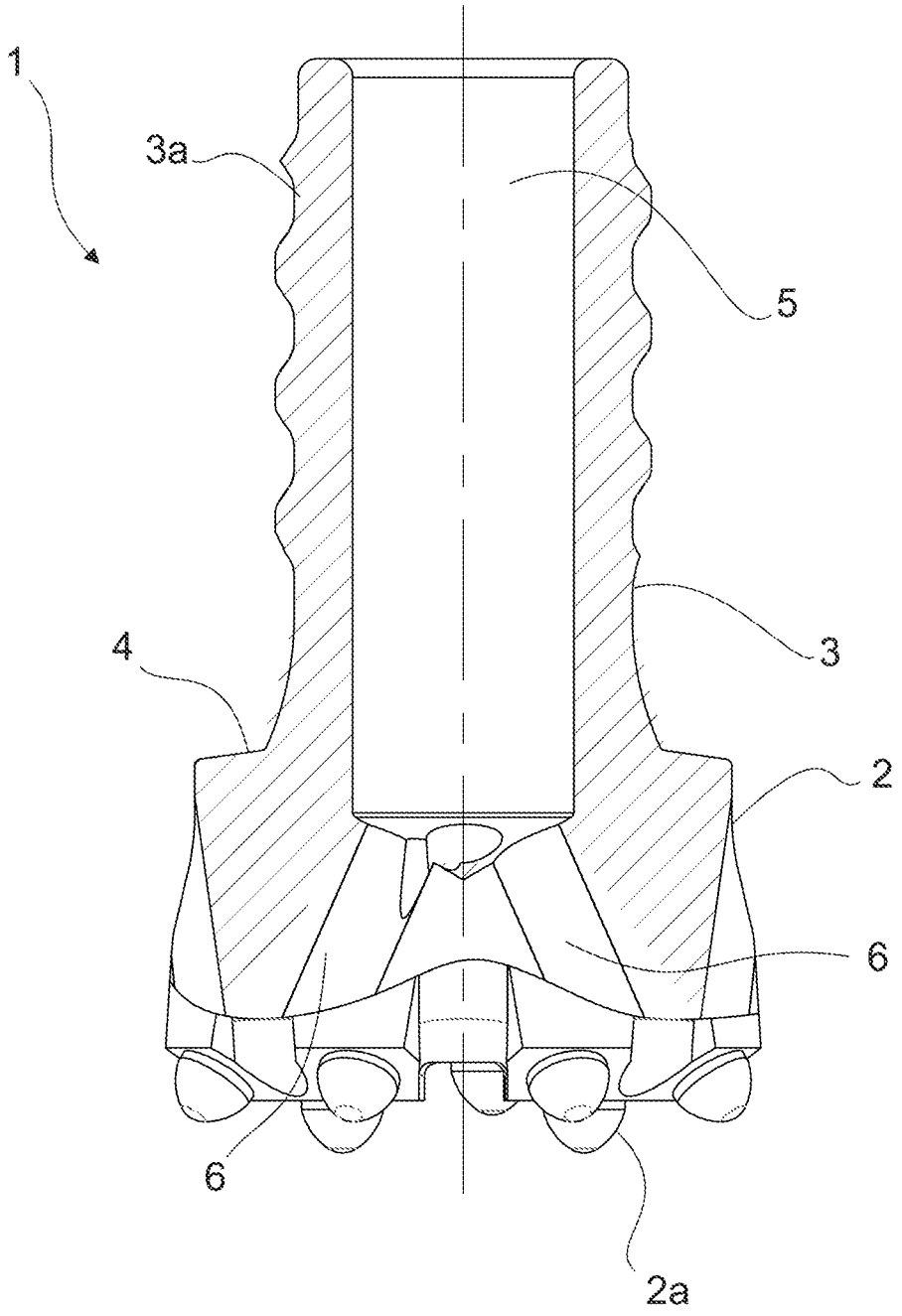
FIG. 1 illustrates a partially cut schematic representation of a drill bit according to an embodiment of the present disclosure.

FIG. 1 illustrates a longitudinally cut schematic representation of a drill bit according to an embodiment of the present disclosure.

Particularly, the drill bit 1 extends longitudinally along its axial direction, such that a downhole portion is provided at a downhole end of the drill bit 1, whereas an attachment portion 3 is provided at an uphole end of the drill bit 1. The downhole portion 2*a* has a generally larger diameter than the attachment portion 3.

The downhole portion 2 has a downhole end surface 2*a*. Although not illustrated in the FIG. 1 the end surface 2*a* is equipped with inserts.

The attachment portion 3 extends from the downhole portion towards the uphole direction, and has cylindrical male coupling thread, denoted with reference numeral 3*a*.

A first annular impact surface 4 is arranged on an uphole-side end of the downhole portion 2, such that it surrounds the attachment portion 3. In the configuration of FIG. 1, the first impact surface is inclined with respect to a plane perpendicular to the longitudinal direction.

Particularly, the first impact surface 4 is inclined radially outwardly towards a downhole direction.

Although not shown in FIG. 1, a second impact surface 9 of the drill string element 7, abuts the first impact surface 4, when the drill string element is coupled to the drill bit 1.

Furthermore, the drill bit 1 comprises a cavity 5 open towards an uphole-side end of the attachment portion 3 and extending longitudinally through the attachment portion 3 for a distance into the downhole portion 2. In the configuration of FIG. 1, the cavity 6 is concentric with longitudinal axis of the drill bit. The conduits 6 illustrated in FIG. 1, in turn, are inclined with respect to the longitudinal direction.

Figure 2:
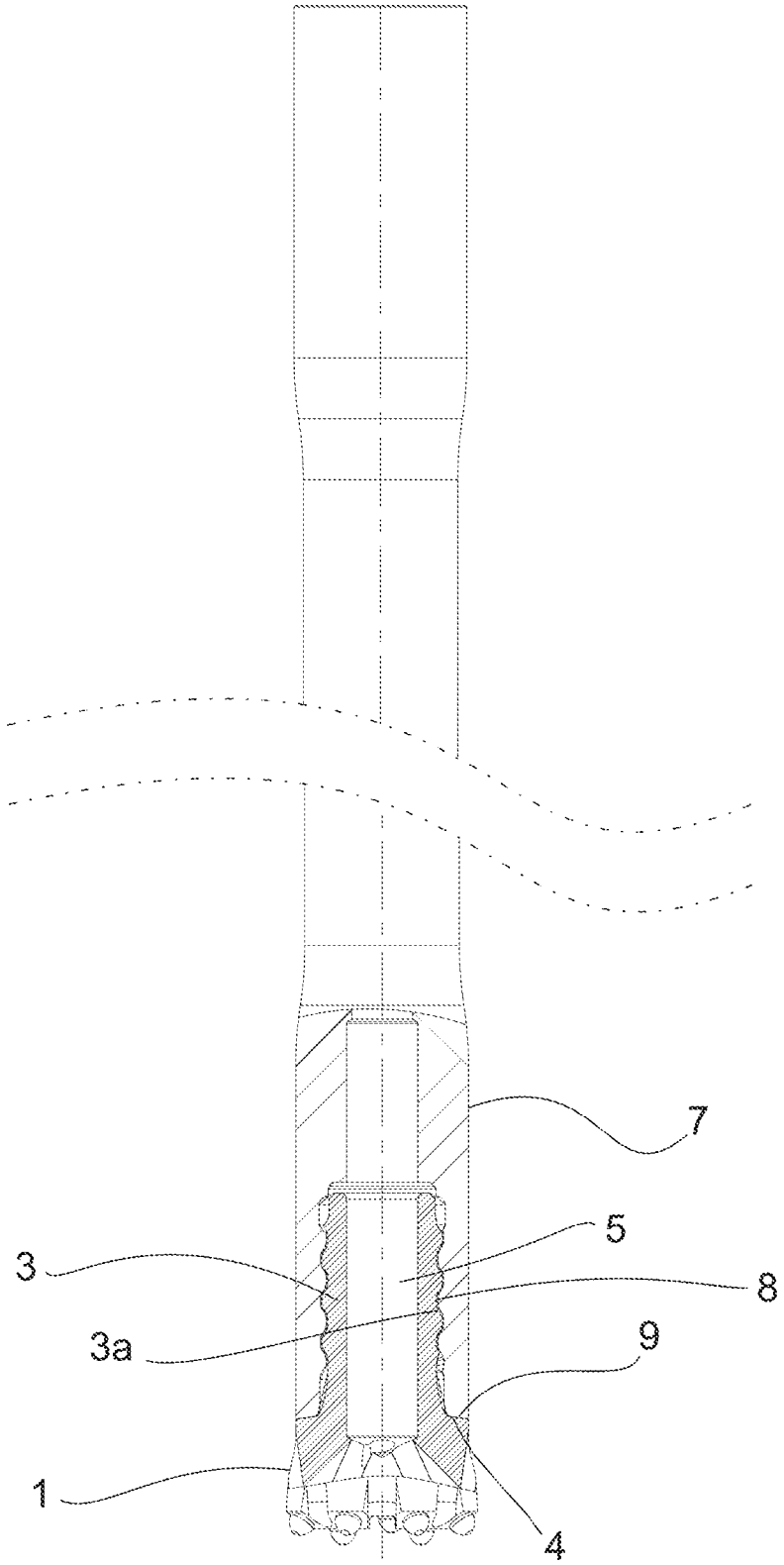
FIG. 2 and FIG. 3 illustrate partially cut schematic representations of drill bit assemblies according to various embodiment of the present disclosure.

FIG. 2 illustrates a partially cut schematic representations of a drill bit assembly according an embodiment of the present disclosure. Particularly, FIG. 2 illustrates a drill bit 1 attached to a drill string element 7. The attachment portion 3 of the drill bit 1 is received within the drill string element 7, such that the male coupling thread 3*a* is engaged with the female coupling thread 8. Furthermore, the first annular impact surface 4 of the drill bit 1 abuts the second annular impact surface 9 of the drill string element 7. In the configuration of FIG. 2 the drill bit 1 corresponds to that illustrated in FIG. 1, whereas the drill string element 7 is provided as a drill tube.

Figure 3:
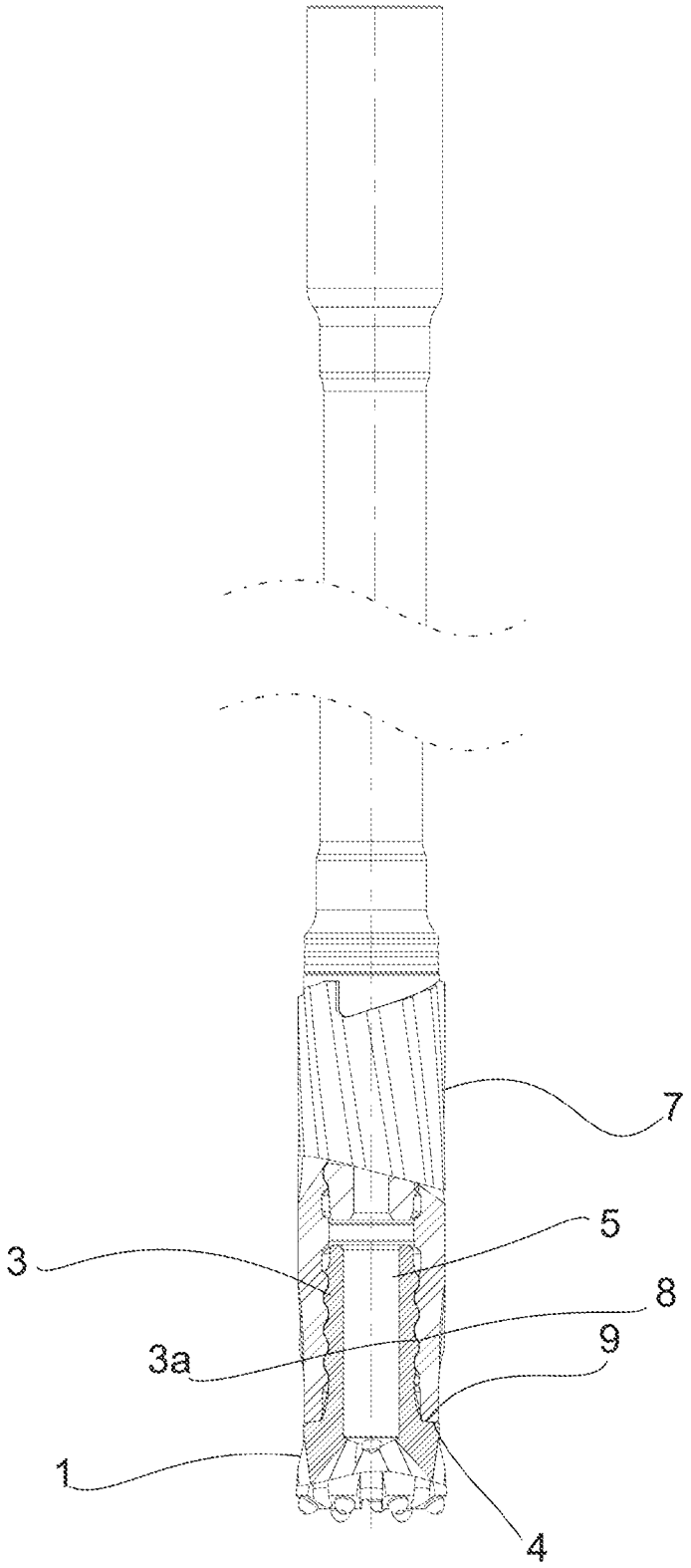

FIG. 3 illustrates a partially cut schematic representations of a drill bit assembly similar to that of FIG. 2, with the exception of the drill string element 7 being provided as an adapter coupling the drill bit 1 to a drill rod.

The invention claimed is:

1. A drill assembly for percussive drilling, the drilling assembly comprising:

a drill bit extending along a longitudinal direction and having:

a downhole portion having a downhole end surface equipped with inserts configured for transferring percussive impacts to points of contact with a borehole, and an attachment portion extending from the downhole portion towards an uphole direction, the attachment portion having a cylindrical male coupling thread; and a cylindrical hollow drill string element configured for transferring at least percussive impacts from a percussion device to the drill bit, the drill string element extending along the longitudinal direction and having, on a downhole-side end thereof, a female coupling thread for threadedly coupling with the male coupling thread;

wherein the drill bit includes a first annular impact surface arranged on an uphole-side end the downhole portion, the first annular impact surface surrounding the attachment portion;

wherein the drill string element includes, at a downhole-side end thereof, a second annular impact surface;

wherein the drill bit is configured to be threadedly coupled with the drill string element such that the first annular impact surface abuts the second annular impact surface so as to transfer percussive impact during operation from the drill string element to the drill bit through the first and second impact surfaces; and wherein the first annular impact surface, and respectively, the second annular impact surface are inclined with respect to a plane perpendicular to the longitudinal direction.

2. The drill assembly according to claim 1, wherein the first annular impact surface, and respectively, the second annular impact surface are inclined radially outwardly towards a downhole direction.

3. The drill assembly according to claim 1, wherein the first annular impact surface, and respectively, the second annular impact surface are inclined at an angle of between 3-20 deg.

4. The drill assembly according to claim 1, wherein the drill bit comprises:

a cavity for conducting a flushing flow, the cavity being open towards an uphole-side end of the attachment portion; and a plurality of conduits extending between the cavity and the end surface of the drill bit for conducting the flushing flow to the end surface.

5. The drill assembly according to claim 4, wherein the cavity has a diameter of at least 2 times that of a conduit.

6. The drill assembly according to claim 4, wherein the cavity extends parallel to the longitudinal direction, and the plurality of conduits are inclined with respect to the longitudinal direction.

7. The drill assembly according to claim 4, wherein a volume defined by the cavity is at least 2 times of that defined by the plurality of conduits.

8. The drill bit according to claim 7, wherein the drill bit comprises:

A cavity for conducting a flushing flow, the cavity being open towards an uphole-side end of the attachment portion; and a plurality of conduits extending between the cavity and the end surface of the drill bit for conducting the flushing flow to the end surface.

9. The drill bit according to claim 8, wherein the cavity has a diameter of at least 2 times that of a conduit.

10. The drill bit according to claim 8, wherein the cavity extends parallel to the longitudinal direction, whereas the plurality of conduits are inclined with respect to the longitudinal direction.

11. The drill bit according to claim 8, wherein a volume defined by the cavity is at least 2 times of that defined by the plurality of conduits.

12. The drill string assembly according to claim 1, wherein the cylindrical hollow drill string element is configured as an adaptor or a drill rod.

13. A drill bit for percussive drilling, the drill bit comprising:

a downhole portion having a downhole end surface equipped with inserts configured for transferring percussive impacts to points of contact with a borehole, and an attachment portion extending from the downhole portion towards an uphole direction, the attachment portion having a cylindrical male coupling thread;

a first annular impact surface arranged on an uphole-side end the downhole portion, the first annular impact surface surrounding the attachment portion; and wherein the drill bit is configured to be threadedly coupled to a drill string such that the first annular impact surface abuts a second annular impact surface of the drill string so as to transfer percussive impact during operation from the drill string element to the drill bit through the first and second annular impact surfaces, wherein the first annular impact surface is inclined with respect to a plane perpendicular to the longitudinal direction.

14. The drill bit according to claim 13, wherein the first annular impact surface is inclined radially outwardly towards a downhole direction.

15. The drill bit according to claim 13, wherein the first annular impact surface is inclined at an angle of between 3-20 deg.

16. A drill string element for percussive drilling configured for transferring at least percussive impacts from a percussion device to a drill bit, the drill string element comprising:

a cylindrical hollow body extending along a longitudinal direction and having, on a downhole-side end thereof, a female coupling thread configured for threadedly coupling with a male coupling thread of a drill bit;

at a downhole-side end thereof, a second annular impact surface;

wherein the cylindrical hollow body is configured to be threadedly coupled to a drill bit such that the second annular impact surface abuts a first annular impact surface of the drill bit so as to transfer percussive impacts from the drill string element to the drill bit through the first and second impact surfaces; and wherein the second annular impact surface is inclined with respect to a plane perpendicular to the longitudinal direction.

17. The drill string element according to claim 16, wherein the second annular impact surface is inclined radially outwardly towards a downhole direction.

18. The drill string element according to claim 16, wherein the second annular impact surface is inclined at an angle of between 3-20 deg.

* * * * *